US007404454B2

(12) United States Patent
Hulick

(10) Patent No.: US 7,404,454 B2
(45) Date of Patent: Jul. 29, 2008

(54) BIT FACE ORIENTATION CONTROL IN DRILLING OPERATIONS

(75) Inventor: Kent Erin Hulick, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 245 days.

(21) Appl. No.: 11/418,842

(22) Filed: May 5, 2006

(65) Prior Publication Data

US 2007/0256861 A1 Nov. 8, 2007

(51) Int. Cl.
*E21B 7/04* (2006.01)

(52) U.S. Cl. ..... 175/26; 175/45; 175/61; 175/73

(58) Field of Classification Search ..... 175/26, 175/45, 48, 61, 73, 74, 75
See application file for complete search history.

(56) References Cited

U.S. PATENT DOCUMENTS

| | | | | |
|---|---|---|---|---|
| 3,658,138 | A | 4/1972 | Gosselin | 173/1 |
| 3,872,932 | A | 3/1975 | Gosselin | 173/1 |
| 4,354,233 | A | 10/1982 | Zhukovsky et al. | 364/420 |
| 4,407,017 | A | 9/1983 | Zhilikov et al. | 364/420 |
| 4,591,006 | A | 5/1986 | Hutchison et al. | 175/52 |
| 4,596,294 | A | 6/1986 | Russell | 175/74 |
| 4,604,724 | A | 8/1986 | Shaginian et al. | 364/478 |
| 4,612,987 | A | 9/1986 | Cheek | 166/212 |
| 4,748,563 | A | 5/1988 | Anthoine | 364/420 |
| 4,793,421 | A | 12/1988 | Jasinski | 175/27 |
| 4,854,397 | A | 8/1989 | Warren et al. | 175/26 |
| 4,995,465 | A | 2/1991 | Beck et al. | 175/27 |
| 5,421,420 | A | 6/1995 | Malone et al. | 175/61 |
| 5,465,799 | A | 11/1995 | Ho | 175/61 |
| 5,503,235 | A | 4/1996 | Falgout, Sr. | 175/61 |
| 6,047,784 | A | 4/2000 | Dorel | 175/61 |
| 6,050,348 | A | 4/2000 | Richarson et al. | 175/26 |
| 6,092,610 | A * | 7/2000 | Kosmala et al. | 175/61 |
| 6,105,690 | A | 8/2000 | Biglin, Jr. et al. | 175/48 |
| 6,176,323 | B1 | 1/2001 | Weirich et al. | 175/40 |
| 6,378,628 | B1 | 4/2002 | McGuire et al. | 175/48 |

(Continued)

FOREIGN PATENT DOCUMENTS

| | | |
|---|---|---|
| GB | 1291655 | 8/1970 |

(Continued)

OTHER PUBLICATIONS

Leveraging Open Source Computer Technology to Improve Drilling Process: Research & Development: Aug. 2003: p. 38.

(Continued)

*Primary Examiner*—William P Neuder

(57) ABSTRACT

A system for selectively orienting a bit at the end of a drillstring in a wellbore, the system, in certain aspects, having: motive apparatus for rotating a drillstring and a bit connected to an end of the drillstring; a control member manually movable to effect a change in orientation of the bit; a control system in communication with the motive apparatus and the control member for translating a signal from the control member indicative of manual movement of the control member into a command to the motive apparatus, the command commanding the motive apparatus to rotate the drillstring and the bit in correspondence to the movement of the control member.

31 Claims, 5 Drawing Sheets

U.S. PATENT DOCUMENTS

| | | | | |
|---|---|---|---|---|
| 6,629,572 | B2 | 10/2003 | Womer et al. | 175/219 |
| 6,719,069 | B2 | 4/2004 | Alft et al. | 175/24 |
| 6,802,378 | B2 | 10/2004 | Haci et al. | 175/26 |
| 6,918,453 | B2 | 7/2005 | Haci et al. | 175/26 |
| 6,968,909 | B2 | 11/2005 | Aldred et al. | 175/26 |
| 6,980,929 | B2 | 12/2005 | Aronstam et al. | 702/188 |
| 7,044,239 | B2 | 5/2006 | Pinckard et al. | 175/57 |
| 7,096,979 | B2 * | 8/2006 | Haci et al. | 175/61 |
| 7,152,696 | B2 | 12/2006 | Jones | 175/61 |
| 2002/0104685 | A1 | 8/2002 | Pinckard et al. | 175/61 |
| 2003/0111268 | A1 | 6/2003 | Alft et al. | 175/73 |
| 2005/0056463 | A1 | 3/2005 | Aronstam et al. | 175/61 |

FOREIGN PATENT DOCUMENTS

| | | |
|---|---|---|
| GB | 2057694 | 8/1980 |

OTHER PUBLICATIONS

V-ICIS Driller's Workstation: Advancing the Technology of Drilling: MD TOTCO A Varco Company: 4 pp.: 1998.

Customer Profile Varco International e-Drill; Montavista Software; 2 pages: 2001.

Varco's Electronic Driller puts new levels of drilling performance and crew safety in your driller's hands Varco Systems A Varco Company: 6 pp.: 2003.

Varco's V-ICIS eD (TM)—integrated control and information at your fingertips; Varco; 4 pp.; 2001.

* cited by examiner

BIT FACE ORIENTATION CONTROL IN DRILLING OPERATIONS

BACKGROUND OF THE INVENTION

1. Field of the Invention

This present invention is directed to drilling operations, systems for controlling the orientation of a drill bit during drilling, and, in certain particular aspects, to controlling bit face orientation during drilling.

2. Description of Related Art

The prior art discloses a wide variety of drilling systems, apparatuses, and methods which use a rotary drive or top drive drilling system with a motor that rotates a drive shaft which in turn rotates a drillstring; including, but not limited to, the disclosures in U.S. Pat. Nos. 6,944,547; 6,918,453; 6,802,378; 6,050,348; 5,465,799; 4,995,465; 4,854,397; and 3,658,138, all incorporated fully herein for all purposes. One of the challenges for directional drilling is ensuring the directional motor is oriented properly for the desired change in drilling direction. This requires the top drive to move the string in order to move to specific positions rather than simply blindly rotating the shaft.

Certain current top drive control interfaces and software allow a driller to perform bit-face orientation movements with a top drive, but often these systems are inaccurate. In one method, the top drive is rotated by applying a speed command (throttle) and a torque limit after selecting a direction. With variable frequency drive top drives, the operator can watch the top drive shaft while slowly opening the throttle and can use the throttle control to stop the shaft when it is in the desired position. This is using the driller as a closed-loop position control portion of the operation, which can be undesirable. For HMI-based human-machine interface top drives, the situation can be worse since the driller must key in a throttle on a touch screen, watch the movement of the drive, then quickly look back at the screen and hit "zero throttle" in order to stop the shaft. This can lead to errors.

In directional drilling, in which target formations may be spaced laterally thousands of feet from a well's surface location requiring penetration to depth and also laterally through soil, rock, and formations, bit direction is determined by the azimuth or face angle of the drilling bit. In certain prior systems, face angle information is measured downhole by a steering tool and, typically, conveyed from the steering tool to the surface using relatively low bandwidth mud pulse signaling. A driller maintains a desired face angle by applying torque or drillstring angle corrections to a drillstring, but because of the latency or delay in receiving face angle information, the driller often over- or under-corrects. The over- or under-correction can result in substantial back and forth wandering of the drill bit, which increases the distance that must be drilled in order to reach the target formation. Back and forth wandering can also increase the risk of stuck pipe and make the running and setting of casing more difficult.

In directional drilling, especially in long reach, high angle, or horizontal drilling, long bit runs, smooth and properly controlled well paths, and minimal course corrections are desirable. In actual drilling, many downhole trajectory control devices are used to deflect the drilling trajectory whenever necessary. These include downhole bent housings of the downhole motor, bent subs or whipstocks, and other active or adjustable devices such as adjustable stabilizers. To properly execute the trajectory deflection, it is very important to set the tool face accurately.

One prior method of setting the tool face angle relies on measuring the tool face angle at the location where downhole survey sensors are located in a BHA (bottomhole assembly). However, due to the interference fit caused by such downhole deflection devices, significant contact forces are generated by such devices at the contact points (i.e., the bent knee and the intervening stabilizers). These restraining torques prevent the bent knee from turning when the surface torque is applied. Therefore, the "apparent tool face" at the sensor location can very often differ significantly from the true tool face angle at the bent knee.

One prior method of downhole tool face setting is to infer a tool face orientation at the axial location where the survey sensors are located through survey measurements. The effect of the "restraining torque" at the bent knee and any other intervening contact locations (such as the upper stabilizer of the downhole motor) may not be accounted for. As a result, not only is accuracy affected, but also the azimuth accuracy of the directional survey, since the survey data are influenced by the deformation of the downhole assembly. Often the azimuth accuracy in an MWD survey, particularly near the horizontal section, can be very poor. Errors of over two degrees in azimuth from such surveys are fairly common. The uncertainty of the well trajectory, due to such azimuthal error, will either lead to strayed drilling or to a crooked horizontal well path. This can limit the maximum drillable horizontal extent of the well.

In rotating a drillstring to rotate a bit to a desired orientation, it is desirable to achieve a new bit face orientation as quickly and accurately as possible, but without fast, jerky movements which may result in overshooting or undershooting a desired bit location.

BRIEF SUMMARY OF THE PRESENT INVENTION

The present invention discloses, in certain aspects, a system for accurately changing bit face orientation.

The present invention, in certain aspects, discloses a system for selectively orienting a bit at the end of a drillstring, the system including: motive apparatus for rotating a drillstring and a bit, the bit connected to an end of the drillstring, the drillstring in a wellbore, the wellbore extending from an earth surface into the earth, the bit at a location beneath the earth surface; a control member apparatus including a control member manually movable by a person to effect a change in orientation of the bit in the wellbore, the control member apparatus including signal apparatus for producing a movement signal indicative of manual movement of the control member; and a control system in communication with the motive apparatus and the control member, the control system for translating a movement signal from the control member apparatus into a command to the motive apparatus, the command commanding the motive apparatus to rotate the drillstring and the bit in correspondence to the movement of the control member. In such a system, in certain aspects the control member is a manually rotatable knob operatively connected with the control system; and/or the control system can include computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, and the control system controlling movement by the motive apparatus so that the speed limit is not exceeded and so that the torque limit is not exceeded.

In one aspect, systems according to the present invention have one or a few (two or more) closed-loop position control modes for a top drive and allow software in a control system to do speed calculation responsibilities pertaining to top drive shaft position limits. In certain particular aspects, the present invention employs either a "Bump" mode or an "Encoder follow" mode. Before entering either mode, the top drive is turned off.

In "Bump" mode an operator inputs to a top drive control system an incremental angular rotation distance (in degrees or revolutions), a speed (in RPM's) for the top drive shaft (and therefore, for the drillstring attached thereto), and a torque limit (limit on torque applied to the drillstring by the top drive motor via the top drive shaft). Once these parameters have been entered, the operator chooses in which direction the drillstring is to be rotated by selecting either "Bump CW" (rotate clockwise) or "Bump CCW" (rotate counterclockwise) and the top drive rotates the drillstring the specified distance in that direction and then stops. In one aspect, the movement is "trapezoidal" following the speed ramp rates defined in the top drive parameters; i.e., to reach a final bit destination point, (final position of the encoder, drive shaft, and of the bit), the top drive is driven at a constant acceleration (see FIG. 4A) until it reaches a constant maximum velocity, then it begins a constant deceleration to the final destination point. In one aspect a constant maximum velocity is not reached (see FIG. 4B) since a constant deceleration is to be achieved following a constant acceleration to reach a final destination point, preferably without overshooting.

Due to the need to enter rotation distances, "Bump" mode is enabled either from HMIs (e.g., graphical displays, touch screens, and/or using a computer mouse) or from hardwired controls for an apparatus such as-a variable frequency drive. In "Bump" mode, an operator enters a distance (rotational distance in radians or turns) in degrees and selects a direction (forward—clockwise or reverse—counterclockwise).

In "Encoder" follow mode, an incremental encoder (e.g., rotatable knob, joystick, or movable slider) located on an operator's console or control station provides a movable or rotary position input to the top drive. The operator provides speed and torque limits and the top drive control software generates speed commands to a variable-frequency-drive controller of a variable frequency drive of the top drive to follow the position of the encoder (knob or slider) as closely as possible given the ramp speed and torque limits. Thus, e.g., with a rotatable knob system, if the operator wants the shaft and, thus, the drill bit to rotate 15 degrees to the right, he simply rotates the knob 15 degrees to the right and the top drive follows so that the drillstring and bit are rotated the same amount in the same direction.

To calculate velocity limits, i.e., the velocity at which the drillstring is rotated, given a position destination, d, and a current position, x (calculated from a position provided by an encoder on the motor shaft), a speed command is given to the variable frequency drive ("VFD") controller to move the top drive shaft properly toward a desired destination. The sign (direction) can simply be calculated by x−d. In one aspect, the control software's existing ramp functions are used. The ramp functions properly ramp up speed increases, so the calculation can focus on limiting the velocity so the shaft will stop, preferably, exactly at the destination. At any given point, given a maximum acceleration value a0, and a distance x, the speed required to perfectly stop at that point is the square root of the product of a0 and x. In certain aspects, it is preferable to not have to calculate square roots repeatedly in code execution as it is a very long calculation; so the ramp functions are used to generate a proper velocity profile (since it uses the proper acceleration value), so the distance required to stop given the current speed is calculated and, if the destination is within some deadband of the stopping distance, the speed input to the ramp is set to zero. The distance required to stop from a given velocity with constant acceleration is: d=v (squared)/a0. Thus the velocity input to the ramp will be vmax (specified by the operator) if the destination is outside of the stop deadband, or 0 if it is within the stop deadband.

In certain embodiments, in order to allow bit face operations to work without an encoder or in the event of an encoder failure, an open-loop mode is used. Open-loop operation is enabled by an operator on a screen (e.g. a touch screen of an operator's console); or to provide functionality where the top drive controller has no encoder data, the control system is permanently configured active. In open loop mode (no data from an encoder regarding shaft position) a shaft position is calculated based on the speed feedback from the top drive and controller cycle time, which is then used in the above velocity limit calculations. This simulated velocity signal is held to zero if the drive is not ready, i.e., no movement is initiated until the drive indicates it is ready.

Using a deadband for the velocity calculation can prevent the drive from repeatedly shifting directions (referred to as "hunt prevention"—"hunt" refers to back-and-forth overshooting of a desired final destination point) trying to achieve smaller position control than physically possible. According to the present invention a certain discrete deadband around a desired destination is defined and, once any position therein is achieved, the bit stops (i.e., no more "hunting"). In certain embodiments, a typical deadband range, e.g., is plus or minus three degrees of top drive shaft rotation.

It is, therefore, an object of at least certain preferred embodiments of the present invention to provide new, useful, unique, efficient, nonobvious systems and methods, including, but not limited to, systems and methods for efficiently, accurately, and effectively orienting a bit in drilling operations, in certain aspects with a top drive system.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE INVENTION

Figure 1:
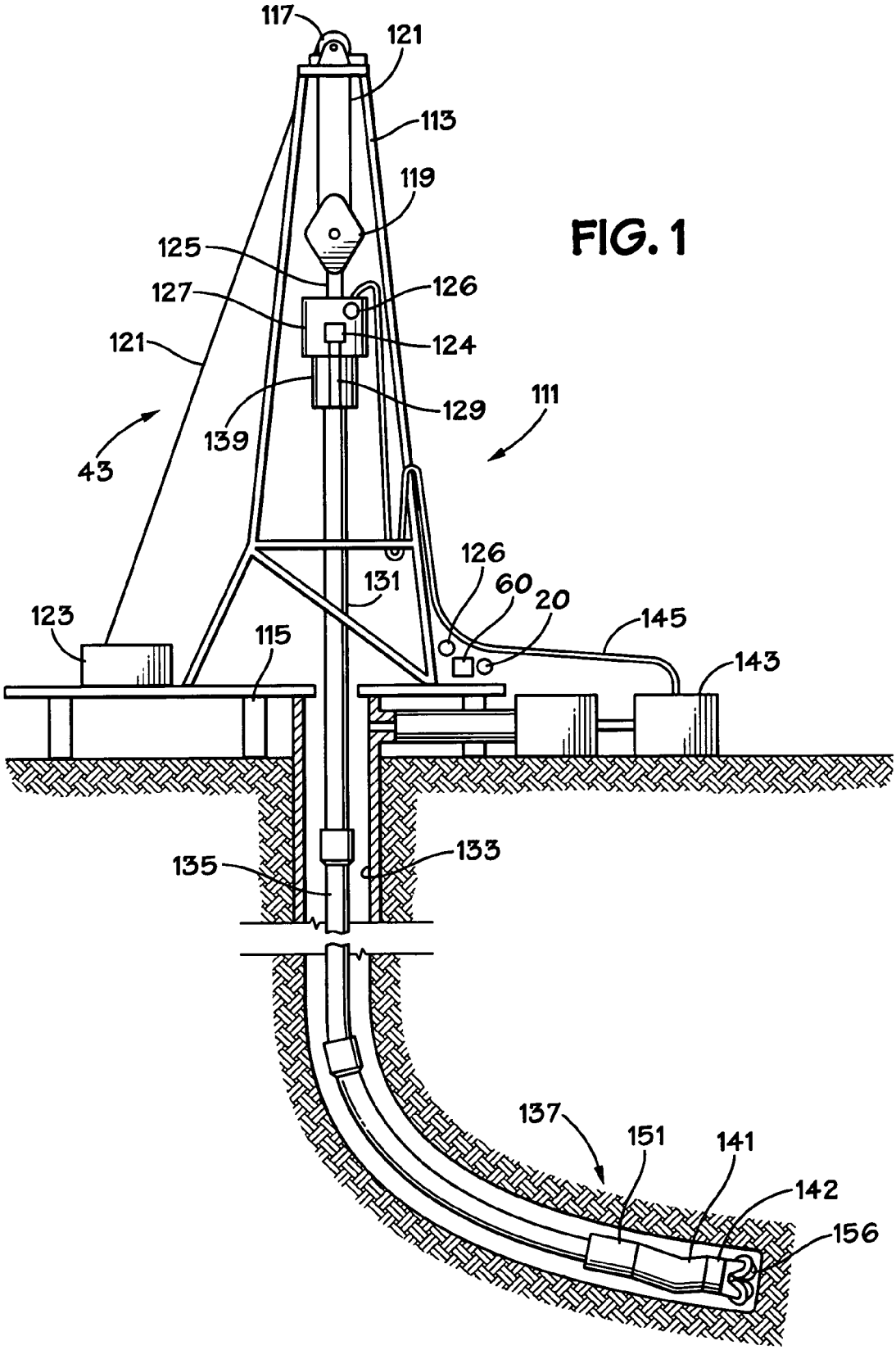
FIG. 1 is a schematic view of a system according to the present invention.

Referring now to FIG. 1, a drilling rig 111 is depicted schematically as a land rig, but other rigs (e.g., offshore rigs, jack-up rigs, semisubmersibles, drill ships, and the like) are within the scope of the present invention. In conjunction with an operator interface, e.g. an interface 20, a control system 60 as described below controls certain operations of the rig. The rig 111 includes a derrick 113 that is supported on the ground above a rig floor 115. The rig 111 includes lifting gear, which includes a crown block 117 mounted to derrick 113 and a traveling block 119. A crown block 117 and a traveling block 119 are interconnected by a cable 121 that is driven by drawworks 123 to control the upward and downward movement of the traveling block 119. Traveling block 119 carries a hook 125 from which is suspended a top drive system 127 which includes a variable frequency drive controller 126, a motor (or motors) 124 and a drive shaft 129. The top drive system 127 rotates a drillstring 131 to which the drive shaft 129 is connected in a wellbore 133. The top drive system 127 can be operated to rotate the drillstring 131 in either direction. According to an embodiment of the present invention, the drillstring 131 is coupled to the top drive system 127 through an instrumented sub 139 which includes sensors that provide information, e.g., drillstring torque information.

The drillstring 131 may be any typical drillstring and, in one aspect, includes a plurality of interconnected sections of drill pipe 135 a bottom hole assembly (BHA) 137, which includes stabilizers, drill collars, and/or an apparatus or device, in one aspect, a suite of measurement while drilling (MWD) instruments including a steering tool 151 to provide bit face angle information. Optionally a bent sub 141 is used with a downhole or mud motor 142 and a bit 156, connected to the BHA 137. As is well known, the face angle of the bit 156 is controlled in azimuth and pitch during drilling.

Drilling fluid is delivered to the drillstring 131 by mud pumps 143 through a mud hose 145. During rotary drilling, drillstring 131 is rotated within bore hole 133 by the top drive system 127 which, in one aspect, is slidingly mounted on parallel vertically extending rails (not shown) to resist rotation as torque is applied to the drillstring 131. During sliding drilling, the drillstring 131 is held in place by top drive system 127 while the bit 156 is rotated by the mud motor 142, which is supplied with drilling fluid by the mud pumps 143. The driller can operate top drive system 127 to change the face angle of the bit 156.

Although a top drive rig is illustrated, it is within the scope of the present invention for the present invention to be used in connection with systems in which a rotary table and kelly are used to apply torque to the drillstring.

The cuttings produced as the bit drills into the earth are carried out of bore hole 133 by drilling mud supplied by the mud pumps 143.

Figure 2:
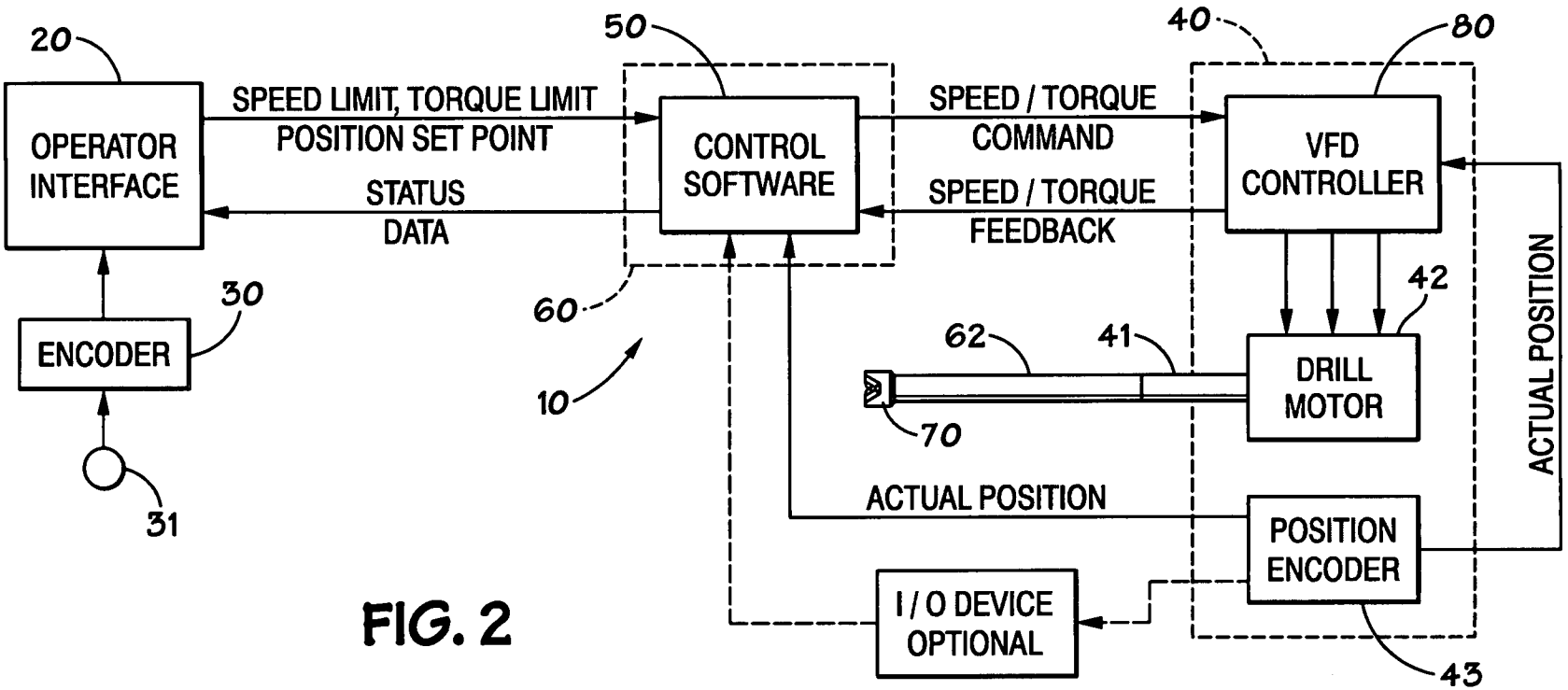
FIG. 2 is a schematic view of a system according to the present invention.

As shown in FIG. 2, a system 10 according to the present invention has an operator interface 20 (e.g., but not limited to, a driller's console and/or one, two, three or more touch screens and/or joystick((s)), slider ((s)) or knob((s)) ) with an optional adjustable encoder 30 for rotating a main shaft 41 of a top drive system 40 (like the system 127, FIG. 1). The adjustable encoder 30 has adjustable apparatus 31 (e.g. a rotatable knob or a movable slider), which, when moved or rotated by the driller or other personnel results in a corresponding movement of the main shaft 41 (like the shaft 129, FIG. 1) of the top drive system 40 and, therefore, of the drillstring and attached bit (as in FIG. 1).

Control software 50 in a programmable medium of the control system 60, e.g., but not limited to, one, two, three or more on-site, or remote computers, PLC's, single board computer(s), CPU(s), finite state machine(s), microcontroller(s), controls the movement of the main shaft 41 in response to the movement of the adjustable apparatus 31 (e.g. at a driller's console) so that the main shaft 41 is not moved too quickly and so that it and a drillstring 62 (like the drillstring 131, FIG. 1) and a bit 70 connected thereto (like the bit 156, FIG. 1) are moved smoothly with a smoothly decreasing declaration as a movement end point is approached. "On-site" may include e.g., but is not limited to, in a driller's cabin and/or in a control room or building adjacent a rig.

A motor 42 of the top drive system 40 rotates the main shaft 41 (which is connected to the drillstring 62) with the drill bit 70 at its end. A VFD controller 80 (like the controller 126, FIG. 1) controls the motor 42. A position encoder 43 (located adjacent the top drive motor) sends a signal indicative of the actual position of the main shaft 41 to the VFD controller 80 and to the control system 60 where it is an input value for the control software 50.

From the operator interface 20, pre-selected limiting values for main shaft speed ("speed limit"); main shaft torque ("torque limit"); and a desired bit position or "Position Set Point" are input to the control system's control software 50. The control system 60 provides status data to the operator interface 20 which includes speed, torque, shaft orientation, and position of the apparatus 31.

The control software 50 sends commands to the VFD controller 80 which include speed commands and torque commands (torque limit). The VFD controller 80 provides feedback to the control software 50 which includes values for actual speed of the main shaft 41 and the actual torque (the torque applied to the drillstring by the top drive motor).

Figure 3:
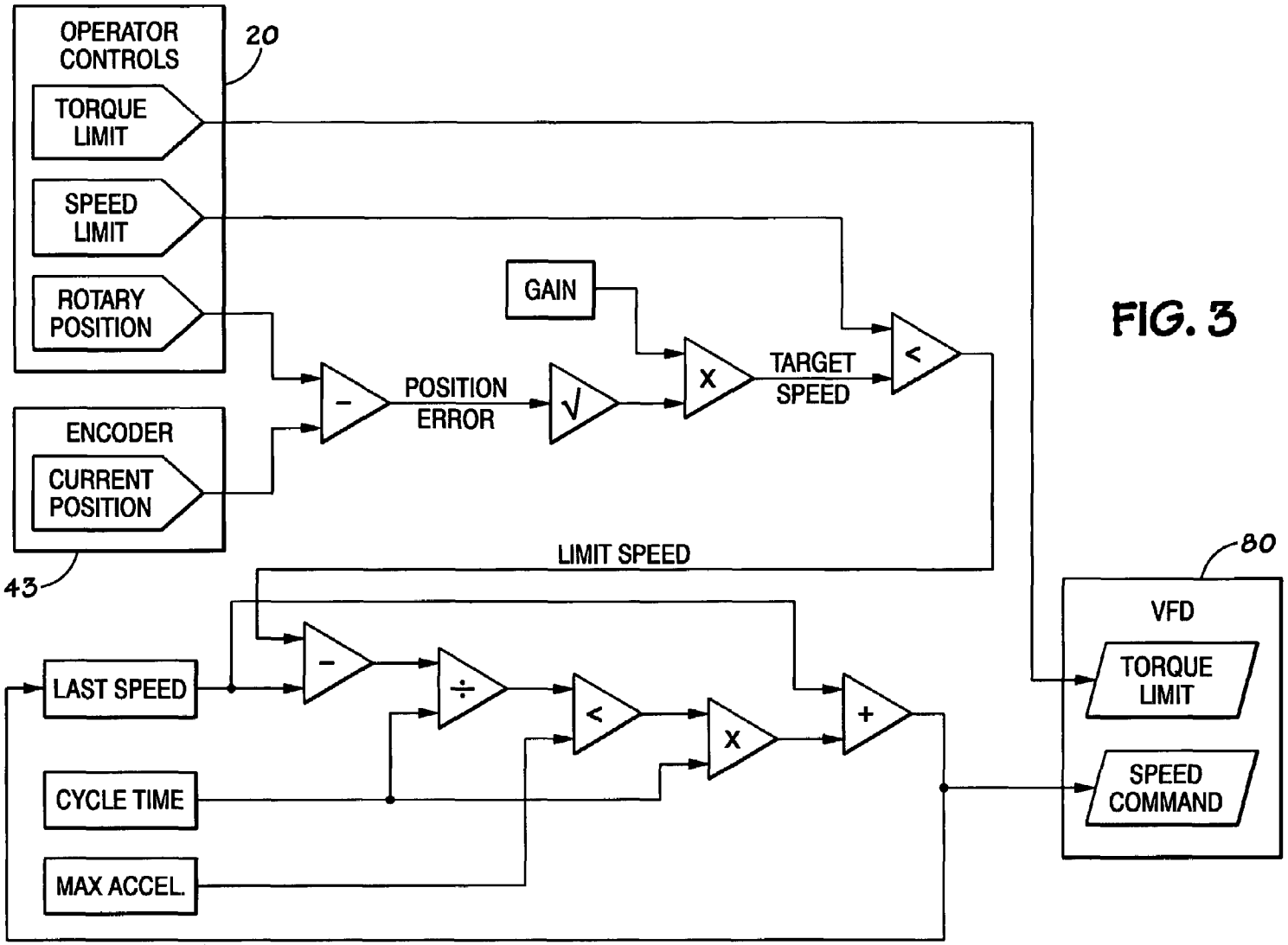
FIG. 3 is a schematic view of a functions of the system of FIG. 2 according to the present invention.

FIG. 3 illustrates functioning of the system 10.

As shown in FIG. 3, the control system 60 then adjusts the speed of the top drive motor and controls the torque applied to the drillstring so that the main shaft of the top drive stops at a desired point. The control system conveys to the control software data values (e.g. fifty per second) for the amount of torque actually applied to the string; and, regarding actual speed, the amount of actual rotation of the string (in degrees or radians). The position encoder 43 has provided position information and velocity information to the VFD controller 80. The control software 50 receives information regarding position from the encoder 43 and/or from the VFD controller 80 or, optionally, through a direct input/output apparatus (e.g. an I/O device in communication with the encoder) controlled by the software 50. The VFD controller 80 constantly uses the position from the encoder 43 to control outputs of the top drive motor to achieve the desired commanded speed and to maintain torque within the torque limit imposed by the control software 50.

The operator using the operator controls on the control interface 20 inputs to the VFD controller 80 a limitation on the torque that is to be applied to the string ("Torque Limit") and a limitation on the speed at which the main shaft 41 of the top drive system 40 is to be rotated ("Speed Limit").

Using the Speed Limit, the actual position of the main shaft, the last speed at which the main drive shaft was rotating ("Last Speed"), the speed commanded by the control system 60, to the VFD controller 80 from the previous control iteration), the maximum allowable acceleration ("Max Accel"), and the cycle time for sending speed commands to the VFD controller 80 (cycle time is provided by a hardware clock, a clock in a CPU, or a clock in the control system 60), the control software 50 calculates a speed command ("Speed Command") which is sent to the VFD controller 80 which, in turn, controls the rotation of the main shaft 41 so that the drillstring is rotated at the desired speed. To re-orient a bit, it is desirable to rotate the string at such a speed that the bit neither overshoots nor undershoots a desired position (orientation) and this is achieved by rotating as quickly as possible; but as the bit approaches the desired position, it is important to decelerate so that overshoot does not occur. Thus, the control software 50 calculates desired speed for the entire period of bit movement and desired speed changes as the bit approaches a desired position. A final speed is such a calculated speed for rotation of the string as the bit nears the desired position.

The VFD controller 80 receives commands from the operator interface 20 so that the VFD controller follows (performs correspondingly to) the adjustable encoder 30. The change of position of the adjustable encoder 30 is monitored by the control software 50 and the difference between the two positions (position indicated by the encoder 30 minus the position indicated by the encoder 43); (position of the encoder 43 divided by the gear ratio of the top drive, the ratio between the rotation of the drill motor to the rotation of the shaft, e.g., but not limited to 10:1, for example, with a gear ratio of 10:1 the encoder 43 moves ten times as much as the encoder 30) is calculated resulting in an amount to move the encoder 30 ("Position Error"). The square root of the position error times a gain factor ("gain") yields a "Target Speed" which is further processed to determine the lesser of the speed limit and the target speed, to yield a momentary speed ("Limit Speed") of rotation of the drillstring to arrive quickly and smoothly at a desired bit orientation/location.

The Last Speed is subtracted from the lesser of the Target Speed and an operator-entered speed limit and the resulting difference is divided by the cycle time to give the needed shaft acceleration. The lesser of this calculated acceleration and the acceleration limit (parameter) is multiplied by the cycle time to give a differential speed which is then added to the Last Speed and sent to the VFD controller 80 as the new speed command.

Figure 4A:
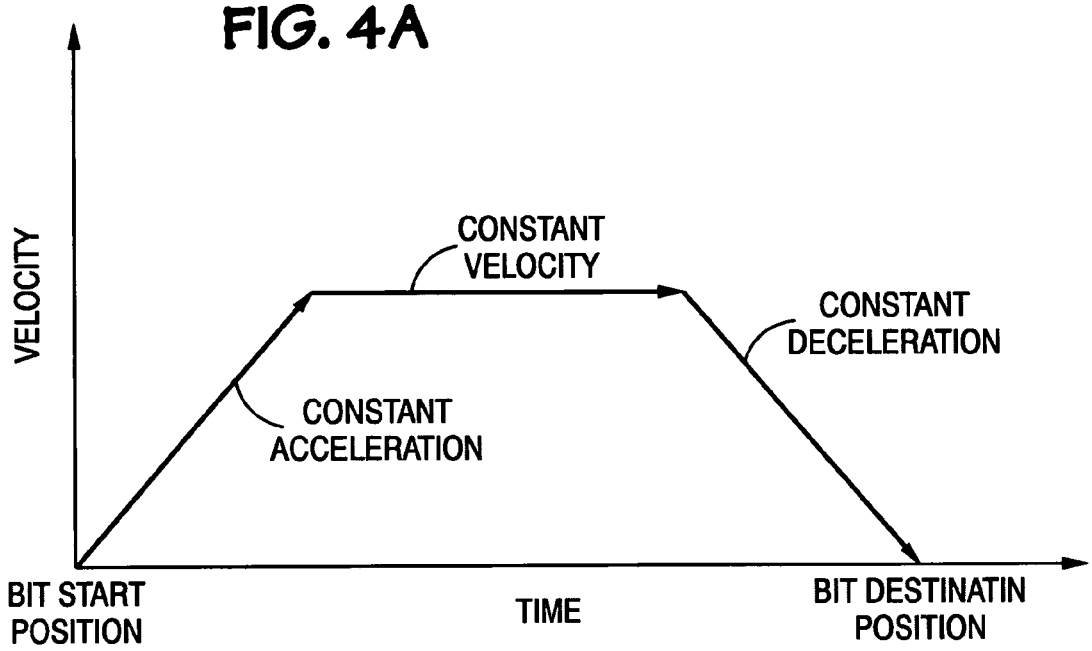
FIG. 4A is a graphic representation of a method according to the present invention.

FIG. 4A illustrates a top drive initially driven at a constant acceleration to move a bit from a "Bit Start Position" to a "Bit Destination Position." For a portion of the movement, a constant velocity is maintained, then, at a calculated point, a constant deceleration is achieved so that the drillstring and, therefore, the attached bit arrive at the destination with no or minimal overshooting. Movement as shown in FIG. 4A is called "trapezoidal" due to the shape of the acceleration and velocity vectors (with the time axis as a base).

Figure 4B:
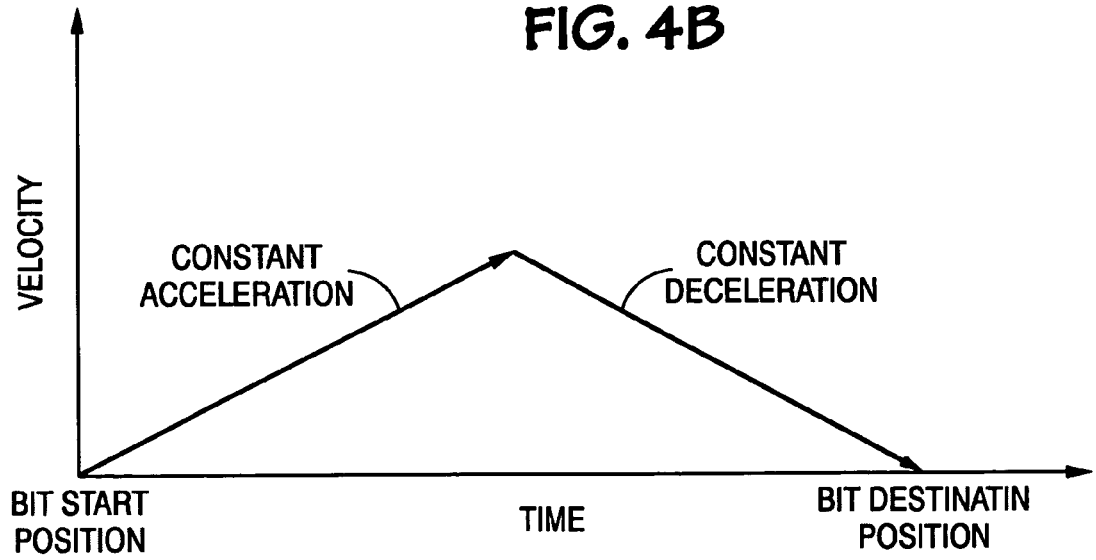
FIG. 4B is a graphic representation of a method according to the present invention.

If the destination is such that a constant velocity is not achieved and maintained, as shown in FIG. 4B, the movement is not "trapezoidal" as in FIG. 4A. Rather, as in FIG. 4B, a constant acceleration of the drillstring and bit is followed by a constant deceleration to the destination.

Figure 5:
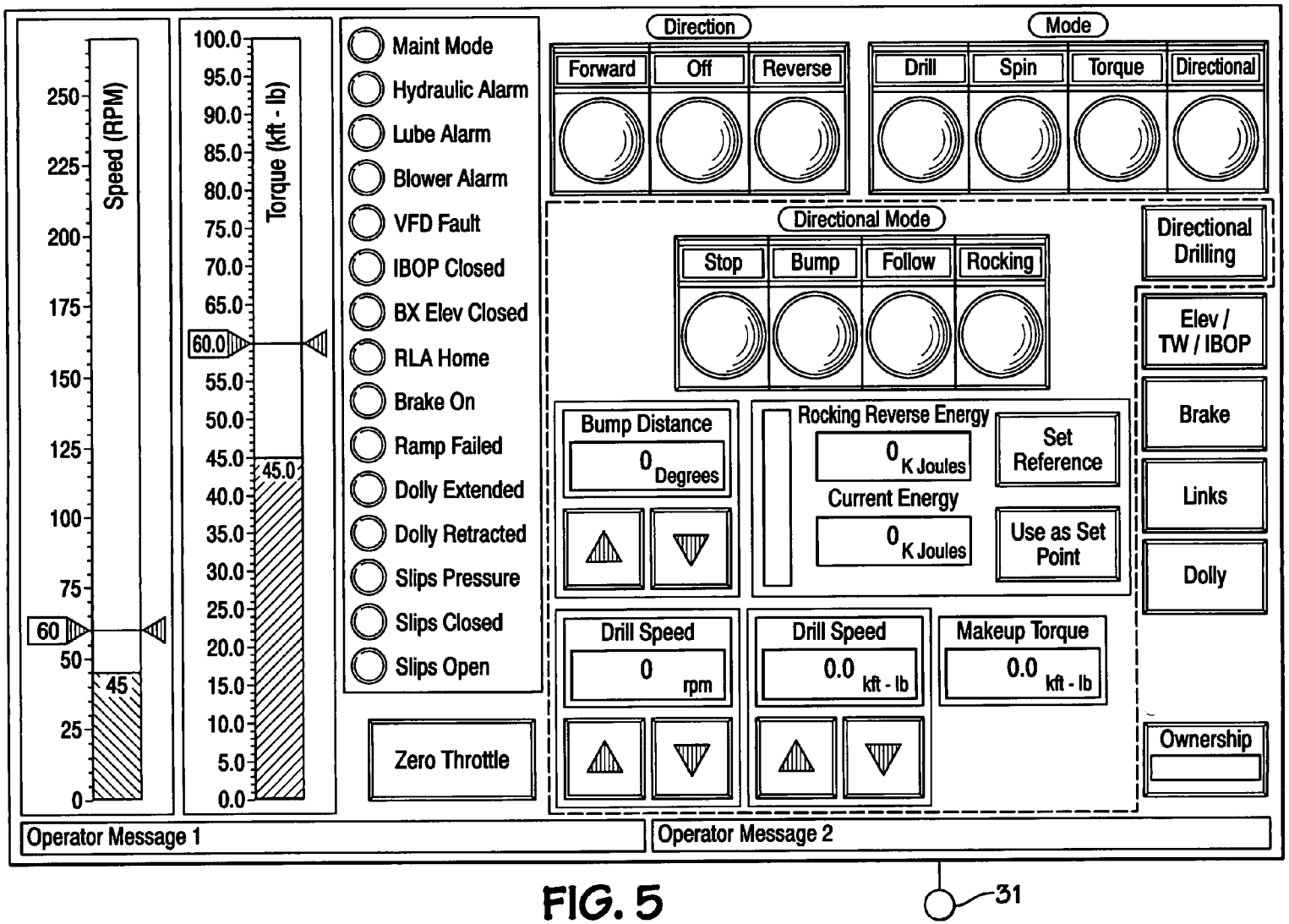
FIG. 5 is a schematic view of a touch screen used in methods according to the present invention.

FIG. 5 shows an operator's interface 20, e.g. a console, e.g. with a touch screen, according to the present invention useful with a control system as described above; e.g., for operating in a bump mode, a follow mode, or a "wag-the-dog" mode for oscillating ("rocking") a drill string according to methods of the present invention (see pending co-owned U.S. application Ser. No. 11/418,843 entitled "Directional Drilling Control" naming Hulick and Cardellini as co-inventors, filed on even date herewith regarding bump mode and rocking mode). But for the "buttons" or areas to be activated by an operator on the touch screen within the dotted line, including the button labelled "Directional Drilling," the screen would be a screen as used in a prior art console used, e.g., in a prior art AMPHION (trademark) system commercially available from National Oilwell Varco. After pushing the "Directional" button, when the "Directional Drilling" button is pushed, the remainder of the buttons within the dotted line appear and an operator can then select to stop—"Stop"—rotation of the drillstring; to move the drillstring (and, therefore, the bit) in bump—"Bump"—mode; to move the drillstring in correspondence to operator movement of a control member (e.g. knob or slider)—"Follow" mode; or to oscillate part of the drillstring to inhibit binding of the drillstring—in "Rocking" mode. Optionally, instead of a single "Bump" button, two buttons may be used—one for "Bump" clockwise and one for "Bump" counterclockwise.

The present invention, therefore, provides in some, but not in necessarily all, embodiments a system for selectively orienting a bit at the end of a drillstring, the system including: motive apparatus for rotating a drillstring and a bit, the bit connected to an end of the drillstring, the drillstring in a wellbore, the wellbore extending from an earth surface into the earth, the bit at a location beneath the earth surface; a control member apparatus including a control member manually movable by a person to effect a change in orientation of the bit in the wellbore, the control member apparatus including signal apparatus for producing a movement signal indicative of manual movement of the control member; a control system in communication with the motive apparatus and the control member, the control system for translating a movement signal from the control member apparatus into a command to the motive apparatus, the command commanding the motive apparatus to rotate the drillstring and the bit in correspondence to the movement of the control member. Such a system may have one or some, in any possible combination, of the following: wherein the control member is a manually rotatable knob operatively connected with the control system; wherein the control system includes computing apparatus programmed for receiving a speed limit input and a torque limit input by an operator person, the speed limit input having a signal indicative of a limit on speed of movement of the drillstring, the torque limit input comprising a signal indicative of a limit on torque applied to the drillstring; the control system controlling movement by the motive apparatus so that the speed limit is not exceeded and so that the torque limit is not exceeded; wherein the motive apparatus is a top drive system; wherein the top drive system includes a top drive and driving of the top drive is done by a variable frequency drive, a variable frequency drive controller controls the variable frequency drive, and the control system controls the variable frequency drive controller; wherein the variable frequency drive controller provides feedback to the control system indicative of actual speed of a drive shaft of the top drive, the drive shaft connected to the drillstring to rotate the drillstring and the bit, and feedback indicative of the actual torque applied to the drillstring by the top drive shaft; wherein the bit is to be moved to a destination position from a starting position, and wherein the control system controls the motive apparatus so that overshooting of the destination position by the bit is eliminated or minimized; wherein the control system calculates a constant acceleration for initial movement by the motive apparatus of the drillstring and bit, a constant velocity for movement by the motive apparatus of the drillstring and bit following movement at a constant acceleration, and a constant deceleration for movement by the motive apparatus of the drillstring and bit to move the bit to a destination position with no or minimal overshooting of the destination position; wherein the control system stops the motive apparatus whenever the speed of rotation of the drillstring and the bit is within a preselected deadband range, thereby stopping rotation of the drillstring and the bit; wherein the motive apparatus is a rotary table system; wherein the control system includes programmable media and control software for accomplishing control functions, the control software into programmable media; wherein the control system includes control apparatus containing the programmable media, the control apparatus from the group consisting of computer, programmable logic controller, single board computer, central processing unit, microcontroller, and finite state machine; an operator interface for an operator to input to the control system limit values for motive apparatus speed, torque to be applied to the drillstring by the motive apparatus, and a desired bit destination position; wherein the control system provides to the operator interface indications of actual motive apparatus speed, actual torque applied to the drillstring, and position of the control member; the motive apparatus having a rotating part for rotating the drillstring, encoder apparatus in communication with the control system, the encoder apparatus for providing a position signal indicative of position of the rotating part of the motive apparatus; wherein the control system continuously uses the position signal from the encoder apparatus to control the motive apparatus; wherein the motive apparatus is a top drive system and the rotating part is a top drive shaft of the top drive system; wherein the bit is to be moved for a period of time to arrive at a bit destination location, the control software for calculating speed for the period of time and speed changes for the bit to approach the bit destination location, the control system for controlling speed of movement of the bit in accordance with calculations of the control software; wherein the system is operable in open-loop mode and wherein the motive apparatus is a top drive system and the rotating part is a top drive shaft of the top drive system; the variable frequency drive provides feedback to the control system regarding speed of the top drive shaft, and the control system for calculating a position of the top drive shaft based on speed feedback from the variable frequency controller and based on an indication of cycle time provided by the control system; and/or wherein the control system includes computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, the control system controlling movement by the motive apparatus so that the speed limit is not exceeded and so that the torque limit is not exceeded, and the control system includes computing apparatus for receiving an incremental angular rotation distance input by the operator person and a drillstring rotation direction input by the operator person, the control system for controlling the top drive system so that the drillstring is rotated the incremental angular rotation distance in the input drillstring rotation direction.

The present invention, therefore, provides in some, but not in necessarily all, embodiments a system for selectively orienting a bit at the end of a drillstring, the system including: motive apparatus for rotating a drillstring and a bit, the bit connected to an end of the drillstring, the drillstring in a wellbore, the wellbore extending from an earth surface into the earth, the bit at a location beneath the earth surface; a control member apparatus including a control member manually movable by a person to effect a change in orientation of the bit in the wellbore, the control member apparatus including signal apparatus for producing a movement signal indicative of manual movement of the control member; a control system in communication with the motive apparatus and the control member, the control system for translating a movement signal from the control member apparatus into a command to the motive apparatus, the command commanding the motive apparatus to rotate the drillstring and the bit in correspondence to the movement of the control member; the control system including computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring; the control system controlling movement by the motive apparatus so that the speed limit is not exceeded and so that the torque limit is not exceeded; wherein the motive apparatus comprises a top drive system; the top drive system includes a top drive and driving of the top drive is done by a variable frequency drive; a variable frequency drive controller controls the variable frequency drive; the control system controls the variable frequency drive controller; the variable frequency drive controller provides feedback to the control system indicative of actual speed of a drive shaft of the top drive, the drive shaft connected to the drillstring to rotate the drillstring and the bit, and feedback indicative of the actual torque applied to the drillstring by the top drive shaft; the bit is to be moved to a destination position from a starting position; wherein the control system controls the motive apparatus so that overshooting of the destination position by the bit is eliminated or minimized; and wherein the control system calculates a constant acceleration for initial movement by the motive apparatus of the drillstring and bit, a constant velocity for movement by the motive apparatus of the drillstring and bit following movement at a constant acceleration, and a constant deceleration for movement by the motive apparatus of the drillstring and bit to move the bit to a destination position with no or minimal overshooting of the destination position.

The present invention, therefore, provides in some, but not in necessarily all, embodiments a method for selectively orienting a bit at the end of a drillstring, the method including moving a control member of a system to orient the bit, the moving done manually by a person, the system as any herein according to the present invention, controlling the motive apparatus with a control system as any herein according to the present invention, and rotating the drillstring and the bit in correspondence to the movement of the control member. Such a method may include moving the drillstring and bit to a destination position with no or minimal overshooting of the destination position.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, the control system including computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, the control system controlling movement by the motive apparatus so that the speed limit is not exceeded and so that the torque limit is not exceeded, wherein the motive apparatus comprises a top drive system, the top drive system includes a top drive and driving of the top drive is done by a variable frequency drive, a variable frequency drive controller controls the variable frequency drive, the control system controls the variable frequency drive controller, the variable frequency drive controller provides feedback to the control system indicative of actual speed of a drive shaft of the top drive, the drive shaft connected to the drillstring to rotate the drillstring and the bit, and feedback indicative of the actual torque applied to the drillstring by the top drive shaft, the bit is to be moved to a destination position from a starting position, wherein the control system controls the motive apparatus so that overshooting of the destination position by the bit is eliminated or minimized, and wherein the control system calculates a constant acceleration for initial movement by the motive apparatus of the drillstring and bit, a constant velocity for movement by the motive apparatus of the drillstring and bit following movement at a constant acceleration, and a constant deceleration for movement by the motive apparatus of the drillstring and bit to move the bit to a destination position with no or minimal overshooting of the destination position.

2. A method for selectively orienting a bit at the end of a drillstring, the method comprising moving a control member of a system to orient the bit, the moving done manually by a person, the system including motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, controlling the motive apparatus with the control system, and rotating the drillstring and the bit in correspondence to the movement of the control member.

3. The method of claim 2 wherein the control system controls movement by the motive apparatus of the drillstring and bit to move the bit to a destination position with no or minimal overshooting of the destination position, the method further comprising moving the drillstring and bit to move the bit to the destination position with no or minimal overshooting of the destination position.

4. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, the control system including computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, and the control system controlling movement by the motive apparatus so that the speed limit is not exceeded and so that the torque limit is not exceeded.

5. The system of claim 4 wherein the control member is a manually rotatable knob operatively connected with the control system.

6. The system of claim 4 wherein the motive apparatus comprises a top drive system.

7. The system of claim 6 wherein the top drive system includes a top drive and driving of the top drive is done by a variable frequency drive, a variable frequency drive controller controls the variable frequency drive, and the control system controls the variable frequency drive controller.

8. The system of claim 7 wherein the variable frequency drive controller provides feedback to the control system indicative of actual speed of a drive shaft of the top drive, the drive shaft connected to the drillstring to rotate the drillstring and the bit, and feedback indicative of the actual torque applied to the drillstring by the top drive shaft.

9. The system of claim 4 wherein the bit is to be moved to a destination position from a starting position, and wherein the control system controls the motive apparatus so that overshooting of the destination position by the bit is eliminated or minimized.

10. The system of claim 7 wherein the control system calculates a constant acceleration for initial movement by the motive apparatus of the drillstring and bit, a constant velocity for movement by the motive apparatus of the drillstring and bit following movement at a constant acceleration, and a constant deceleration for movement by the motive apparatus of the drillstring and bit to move the bit to a destination position with no or minimal overshooting of the destination position.

11. The system of claim 4 wherein the control system stops the motive apparatus whenever the speed of rotation of the drillstring and the bit is within a preselected dead band range, thereby stopping rotation of the drillstring and the bit.

12. The system of claim 4 wherein the motive apparatus is a rotary table system.

13. The system of claim 4 wherein the control system includes programmable media and control software for accomplishing control functions.

14. The system of claim 13 wherein the control system includes control apparatus containing the programmable media, the control apparatus from the group consisting of computer, programmable logic controller, single board computer, central processing unit, microcontroller, and finite state machine.

15. The system of claim 4 further comprising an operator interface for an operator to input to the control system limit values for motive apparatus speed, torque to be applied to the drillstring by the motive apparatus, and a desired bit destination position.

16. The system of claim 15 wherein the control system provides to the operator interface indications of actual motive apparatus speed, actual torque applied to the drillstring, and position of the control member.

17. The system of claim 4 further comprising the motive apparatus having a rotating part for rotating the drillstring, and encoder apparatus in communication with the control system, the encoder apparatus for providing a position signal indicative of position of the rotating part of the motive apparatus.

18. The system of claim 17 wherein the control system continuously uses the position signal from the encoder apparatus to control the motive apparatus.

19. The system of claim 18 wherein the motive apparatus is a top drive system and the rotating part is a top drive shaft of the top drive system.

20. The system of claim 13 wherein the bit is to be moved for a period of time to arrive at a bit destination location, the control software for calculating speed for the period of time and speed changes for the bit to approach the bit destination location, and the control system for controlling speed of movement of the bit in accordance with calculations of the control software.

21. The system of claim 4 wherein the system is operable in open-loop mode and wherein the motive apparatus is a top drive system and the rotating part is a top drive shaft of the top drive system, the variable frequency drive provides feedback to the control system regarding speed of the top drive shaft, and the control system for calculating a position of the top drive shaft based on speed feedback from the variable frequency controller and based on an indication of cycle time provided by the control system.

22. The system of claim 19 wherein the control system includes computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, the control system controlling movement by the motive apparatus so that the speed limit is not exceeded and so that the torque limit is not exceeded, and the control system includes computing apparatus for receiving an incremental angular rotation distance input by the operator person and a drillstring rotation direction input by the operator person, the control system for controlling the top drive system so that the drillstring is rotated the incremental angular rotation distance in the input drillstring rotation direction.

23. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, the motive apparatus comprising a top drive system, the top drive system including a top drive and driving of the top drive is done by a variable frequency drive, a variable frequency drive controller controls the variable frequency drive, and the control system controls the variable frequency drive controller.

24. The system of claim 23 wherein the variable frequency drive controller provides feedback to the control system indicative of actual speed of a drive shaft of the top drive, the drive shaft connected to the drillstring to rotate the drillstring and the bit, and feedback indicative of the actual torque applied to the drillstring by the top drive shaft.

25. The system of claim 23 wherein the control system calculates a constant acceleration for initial movement by the motive apparatus of the drillstring and bit, a constant velocity for movement by the motive apparatus of the drillstring and bit following movement at a constant acceleration, and a constant deceleration for movement by the motive apparatus of the drillstring and bit to move the bit to a destination position with no or minimal overshooting of the destination position.

26. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, the motive apparatus having a rotating part for rotating the drillstring, and encoder apparatus in communication with the control system, the encoder apparatus for providing a position signal indicative of position of the rotating part of the motive apparatus.

27. The system of claim 26 wherein the control system continuously uses the position signal from the encoder apparatus to control the motive apparatus.

28. The system of claim 27 wherein the motive apparatus is a top drive system and the rotating part is a top drive shaft of the top drive system.

29. The system of claim 28 wherein the control system includes computing apparatus programmed for receiving a speed limit input and a torque limit input by an operator person, the speed limit input comprising a signal indicative of a limit on speed of movement of the drillstring, the torque limit input comprising a signal indicative of a limit on torque applied to the drillstring, the control system controlling movement by the motive apparatus so that the speed limit is not exceeded and so that the torque limit is not exceeded, and the control system includes computing apparatus for receiving an incremental angular rotation distance input by the operator person and a drillstring rotation direction input by the operator person, the control system for controlling the top drive system so that the drillstring is rotated the incremental angular rotation distance in the input drillstring rotation direction.

30. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, the control system including programmable media and control software for accomplishing control functions, the bit is to be moved for a period of time to arrive at a bit destination location, the control software for calculating speed for the period of time and speed changes for the bit to approach the bit destination location, and the control system for controlling speed of movement of the bit in accordance with calculations of the control software.

31. A system for selectively orienting a bit at the end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control member apparatus including a control member manually movable by a person to effect a change in orientation of the bit in the wellbore, the control member apparatus including signal apparatus for producing a movement signal indicative of manual movement of the control member, a control system in communication with the motive apparatus and the control member, the control system for translating a movement signal from the control member apparatus into a command to the motive apparatus, the command commanding the motive apparatus to rotate the drillstring and the bit in correspondence to the movement of the control member, wherein the system is operable in open-loop mode and wherein the motive apparatus is a top drive system and the rotating part is a top drive shaft of the top drive system, the variable frequency drive provides feedback to the control system regarding speed of the top drive shaft, and the control system for calculating a position of the top drive shaft based on speed feedback from the variable frequency controller and based on an indication of cycle time provided by the control system.

* * * * *